United States Patent [19]

Eads et al.

[11] Patent Number: 4,478,409

[45] Date of Patent: Oct. 23, 1984

[54] SWING CHAIN

[76] Inventors: Thomas C. Eads, 2657 Clove, San Diego, Calif. 92016; Dean R. Carlson, P.O. Box 896, La Jolla, Calif. 92038

[21] Appl. No.: 395,486

[22] Filed: Jul. 6, 1982

[51] Int. Cl.[3] ..... A63G 9/00

[52] U.S. Cl. ..... 272/85; 297/278; 272/900

[58] Field of Search ..... 272/85, 86; 297/278, 297/273, 274–283; 5/108, 124, 127

[56] References Cited

U.S. PATENT DOCUMENTS

| | | | |
|---|---|---|---|
| 236,630 | 1/1881 | Robinson | 297/278 |
| 340,687 | 4/1886 | Thompson | 297/278 |
| 358,701 | 3/1887 | Shepardson | 297/278 |
| 425,248 | 3/1890 | Peck | 297/278 |
| 427,900 | 5/1890 | Pearson | 5/124 |
| 787,556 | 3/1905 | Bottgar | 297/278 |
| 953,591 | 3/1910 | Bringham | 297/279 |
| 972,711 | 10/1910 | Palmer | 5/124 |
| 1,159,069 | 11/1915 | Motznik | 5/124 |
| 2,398,384 | 4/1946 | Meyers | 297/148 |
| 2,545,571 | 3/1951 | Charn | 297/273 |
| 4,002,360 | 1/1977 | Ortize | 297/273 |
| 4,244,622 | 1/1981 | Simpson | 297/273 |
| 4,268,087 | 5/1981 | Sorrentino | 297/272 |

*Primary Examiner*—Richard C. Pinkham
*Assistant Examiner*—T. Brown
*Attorney, Agent, or Firm*—Brown & Martin

[57] ABSTRACT

A hanging chair includes a generally rectangular seat frame and a generally rectangular backrest frame pivotally attached to the seat frame with a pliable sheet secured to and extending across the seat frame for providing a seat support surface and a pliable sheet attached to and extending across a portion of the backrest frame for providing a backrest and including flexible support members such as cables secured to the seat frame for hanging the chair from an overhead structure. The frame includes parallel spaced apart side rails, each side rail having an integral arm extending downwardly and backwardly at the front end. A front cross member is connected between the arms at their lower terminal ends.

8 Claims, 4 Drawing Figures

10
12
14
14a
16
16a
18
20
22
24
26
28
28a
30
30a
32
34
36
37
38
39
40
41
42
44
46
48
50
52
54
56
58
60
4

SWING CHAIN

BACKGROUND OF THE INVENTION

The present invention relates to chairs and pertains particularly to special purpose hanging chairs.

Hanging chairs and other similar support devices for body support of the surface of the ground or floor are well-known in the art. Hanging chairs where support structure is available has among its advantages that of being easily adjusted as to its height with respect to the floor or other similar support surface. In addition, such chairs have the advantage of leaving the floor or similar support surface clear of obstructions.

Although many hanging-type chairs and the like are known in the art, improvements in such chairs are still desirable. Moreover, certain special purpose chairs are likewise desirable. The present invention, although developed for a certain special primary purpose, has great general utility.

SUMMARY AND OBJECTS OF THE INVENTION

It is the primary object of the present invention to provide an improved hanging chair.

In accordance with the primary aspect of the present invention, a hanging chair includes a generally rectangular seat support frame having a generally rectangular backrest support frame with detachable pliable panels of material secured to and extending across the respective seat and back frames for providing the respective support thereof. Flexible cable support means are secured to the seat frame and to overhead support structure.

BRIEF DESCRIPTION OF THE DRAWINGS

The above and other objects and advantages of the present invention will become apparent from the following descriptions when read in conjunction with the drawings wherein.

DETAILED DESCRIPTION OF PREFERRED EMBODIMENTS

Figures 1, 2, 3, 4:
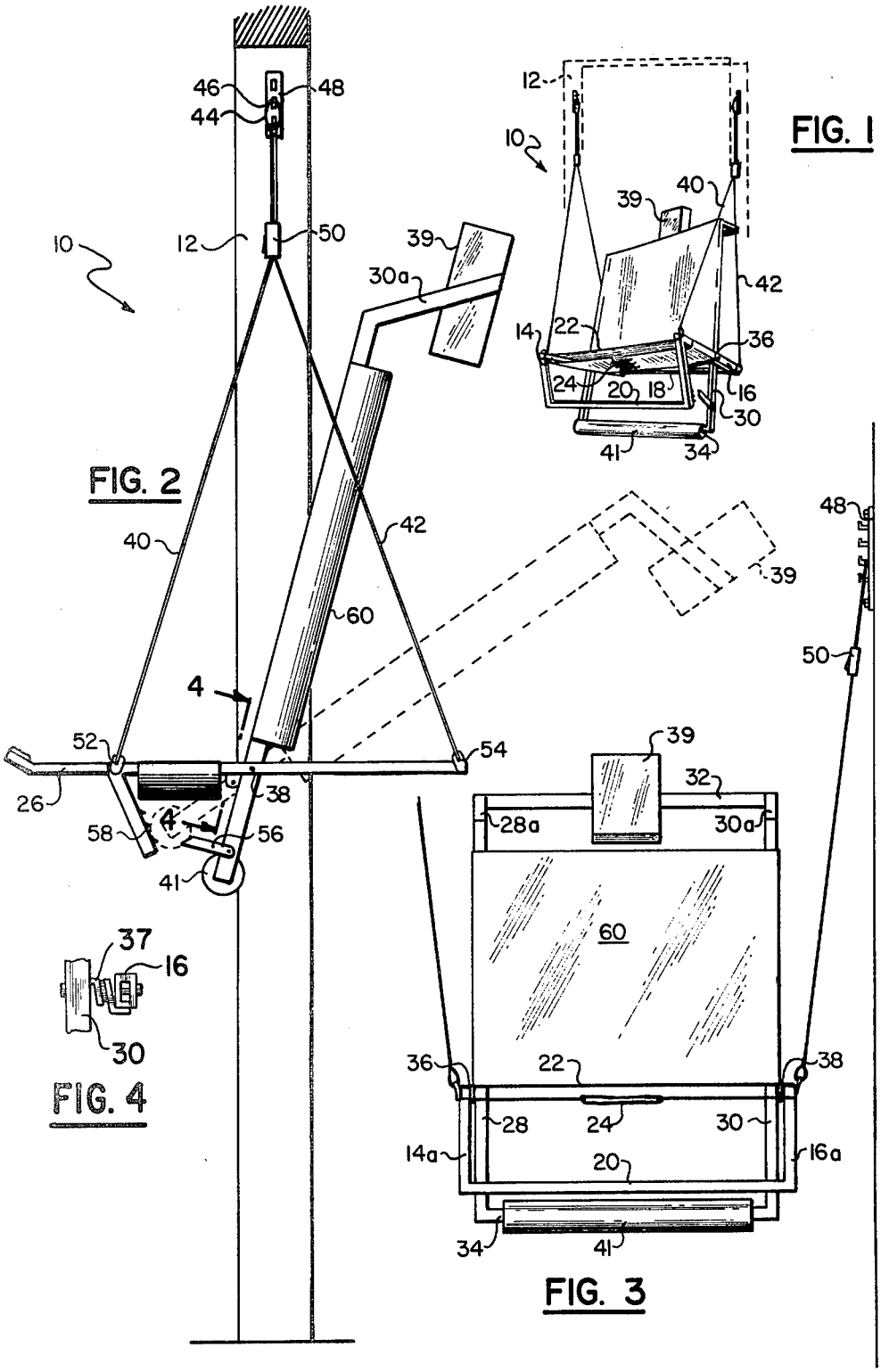
FIG. 1 is a perspective view of a preferred embodiment of the invention.
FIG. 2 is a side elevation view of the embodiment of FIG. 1.
FIG. 3 is a front elevation view of the embodiment of FIG. 1.
FIG. 4 is a section view taken generally on line 4—4 of FIG. 2.

Turning to the drawings and, as more specifically illustrated in FIG. 1, a hanging chair in accordance with the invention designated generally by the numeral 10 is shown mounted in and supported by the frame of a doorway 12. The chair is preferable of a tubular frame construction with pliable sheet material covering as will be subsequently explained. The chair comprises a base or seat frame assembly including a pair of spaced apart elongated side rails 14 and 16 which extend generally parallel with each having the front end thereof curved downward and slightly backward forming arm portions 14*a* and 16*a*. The side rails 14 and 16 extend preferably generally parallel and are connected together at the back end by means of a back cross bar or member 18 and at the front end by a front cross bar or member 20. As can be seen from FIGS. 1 and 2, the front bar 20 is displaced downward and backward from the front edge of the seat panel. This structure provides a generally rectangular seat frame on which the seat surface or platform is mounted.

In the preferred embodiment, the seat is formed of a generally rectangular panel 22 of durable pliable material, such as a fabric, leather, vinyl or other similar materials, which is placed over the top of the side rails 14 and 16 with the ends thereof brought together or in close proximity beneath the rails and laced together by a lace 24. This permits easy replacement of the seat covering or panel when desired. In addition, it permits an adjustment in the tightness or slackness of the seat as desired.

The frame is preferably of a square tubular construction and each of the side rails 14 and 16 are constructed to be open at the forwardmost portion thereof providing a mounting tube for telescopically receiving a pair of stirrups 26. It has been found that frictional engagement between the telescoping members in most instances eliminates the need for clamping screws and the like for the stirrups.

The backrest of the chair comprises a generally rectangular frame of tubular members comprising a pair of elongated side bar members 28 and 30 which are spaced apart and curved backward at an angle at the upper end thereof providing arms 28*a* and 30*a*. These two side bars are connected together by an upper cross bar or member 32 connected between the upper ends of the side bars 28 and 30 and a lower cross bar or member 34 connected between the lower end of the side bar members 28 and 30. This frame is pivotally connected by hinge members 36 and 38 to the side rails 14 and 16 and include a coil-type spring 37, torque spring, at each hinge which engages the respective members 14 and 28 and 16 and 30, and biases the back rest to a normal upright position, slightly inclined as shown in FIG. 2. A pad 41 of generally foam rubber-type composition is mounted on the lower cross bar 34 and functions to engage and lift the seat 22 when the backrest is in the fully reclined position. A headrest 39 is mounted on the upper cross bar 32.

The suspension system for the chair comprises a pair of cable units, one for each side of the chair. These cable units may be any suitable form such as woven strap, fiber rope, or steel cable. The cable units each comprise a single cable having a fore and an aft strand 40 and 42, respectively, forms a loop or connected to loop means 44 at about the center thereof, which is adapted to be detachably secured to any one of a plurality of hooks 46 on a mounting plate 48. The mounting plate 48 is secured to a suitable support structure such as the frame 12 of a doorway. The mounting plate is preferably elongated and having a plurality of vertically spaced hooks permit selectively adjusting the height of the chair. An adjustable clamp 50 holds the cables at any selected setting and permits an adjustment of the angle of the seat as can be appreciated from FIG. 2. The cables are each connected at the lower end to forward tabs 52 and rear tabs 54 attached to each side of the frame of the chair.

The backrest of the chair as will be appreciated from FIG. 2 is pivotally secured to the side rails of the seat frame at a position approximately $\frac{1}{3}$ of the distance from the forwardmost portion thereof to the rear end thereof. The seat portion 22 is thus rather shallow in depth from the front edge thereof to the backrest. The backrest is supported and biased to its upright position and can be pivoted to the fully reclined position. The biasing of the backrest can be adjusted by means of stronger torsion springs or by means of increasing the pretension in the spring. A latching arm or pawl 56 is pivotally mounted on the side bar member 30 and is pivotal into latching engagement with ratchet teeth 58 on the lower arm 16*a* of the side rail 16. This permits selected adjustment in the inclination of the backrest.

The backrest in formed by a panel 60 of material such as fabric, leather or the like, similar to that of the seat. The back panel 60 may be attached to the frame in any suitable manner, but is preferably easily removable.

While we have illustrated and described our invention by means of specific embodiments, it is to be understood that numerous changes and modifications may be made therein without departing from the spirit and scope of the invention as defined in the appended claims.

We claim:

1. A hanging chair adapted to be suspended from an overhead structure, said chair comprising:

a generally rectangular seat support frame comprising a pair of elongated generally parallel side rails connected together at a front and a back end thereof by front and back cross members, a generally horizontal seat panel secured to and extending between said side rails, a back rest frame including a pair of generally parallel side members pivotally connected to the side rails of said seat support frame intermediate the ends thereof and biased to a position extending upwardly therefrom, a back support panel secured to and extending between said side members, cable means connected to said side rails for connecting to overhead support means for supporting said chair, said side rails including arms integral therewith and extending downwardly and backwardly at the front end thereof, and said front cross member is displaced aft and below the forwardmost portion of said seat support and connected between said arms.

2. The hanging chair of claim 1 wherein:

said backrest in pivotable to a reclining position.

3. A hanging chair adapted to be suspended from an overhead structure, said chair comprising:

a generally rectangular seat support frame comprising a pair of elongated generally parallel side rails having integral arm portions extending downwardly and backwardly at a front end thereof and connected together at the outer ends of said arms and a back end thereof by front and back cross members, said front cross member is displaced aft and below the forwardmost portion of said seat support, a generally horizontal seat panel secured to and extending between said side rails, a back rest frame including a pair of generally parallel side members pivotally connected to the side rails of said seat support frame intermediate the end thereof and pivotable to a reclining position and biased to a position extending upwardly therefrom, a back support panel secured to and extending between said side members, cable means connected to said side rails for connecting to overhead support means for supporting said chair, said backrest frame includes upper and lower cross members connecting said side members together at the ends thereof, and said lower cross member is positioned below said side rails and engages and raises said seat when said backrest is in substantially its fully reclining position.

4. The hanging chair of claim 3 wherein:

said side members are curved backward at the upper end thereof, and said upper cross member is displaced backward of the plane of the back seat, and includes a headrest mounted thereon proximate the center thereof.

5. The hanging chair of claim 4 wherein said side rails are tubular and open at the forwardmost portion thereof, and further including a pair of stirrups telescopically mounted in said side rails.

6. The hanging chair of claim 5 wherein said seat support frame and said backrest frame are constructed of square tubes.

7. The hanging chair of claim 6 wherein said cable means comprises a single cable for each side of said chair, each cable connected at opposite ends to opposite ends of said side rails.

8. The hanging chair of claim 7 further including an adjustable clamp for selectively clamping each cable in selected positions of adjustment of the tilt of said chair.

* * * * *

UNITED STATES PATENT AND TRADEMARK OFFICE

CERTIFICATE OF CORRECTION

PATENT NO. : 4,478,409

DATED : October 23, 1984

INVENTOR(S) : Thomas C. Eads and Dean R. Carlson

It is certified that error appears in the above-identified patent and that said Letters Patent is hereby corrected as shown below:

On the Title Page, change the title to read

--SWING CHAIR--.

Signed and Sealed this

*Twenty-fifth* Day of *June 1985*

[SEAL]

*Attest:*

DONALD J. QUIGG

*Attesting Officer*

*Acting Commissioner of Patents and Trademarks*